US011265973B2

(12) United States Patent
Kwack et al.

(10) Patent No.: US 11,265,973 B2
(45) Date of Patent: Mar. 1, 2022

(54) INDUCTION HEATING DEVICE HAVING IMPROVED CONTROL ALGORITHM AND CIRCUIT STRUCTURE

(71) Applicant: LG Electronics Inc., Seoul (KR)

(72) Inventors: Younghwan Kwack, Seoul (KR); Seongho Son, Seoul (KR); Jaekyung Yang, Seoul (KR); Yongsoo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 394 days.

(21) Appl. No.: 16/180,593

(22) Filed: Nov. 5, 2018

(65) Prior Publication Data

US 2019/0357320 A1 Nov. 21, 2019

(30) Foreign Application Priority Data

May 16, 2018 (KR) ..... 10-2018-0056189

(51) Int. Cl.
*H05B 6/06* (2006.01)
*H05B 6/12* (2006.01)

(52) U.S. Cl.
CPC ..... *H05B 6/065* (2013.01); *H05B 6/1209* (2013.01)

(58) Field of Classification Search
CPC ... H05B 6/04; H05B 6/06; H05B 6/08; H05B 6/44; H05B 6/065; H05B 6/1263;
(Continued)

(56) References Cited

U.S. PATENT DOCUMENTS 9,277,598 B2 * 3/2016 Lee ..... H05B 6/1263
2008/0164249 A1 * 7/2008 Gil ..... H05B 6/062 219/620

(Continued)

FOREIGN PATENT DOCUMENTS

EP 2642819 9/2013
JP 5279620 12/2010

(Continued)

OTHER PUBLICATIONS

Extended European Search Report in European Application No. 18201889.5, dated May 10, 2019, 5 pages.

*Primary Examiner* — Ibrahime A Abraham
*Assistant Examiner* — Simpson A Chen
(74) *Attorney, Agent, or Firm* — Fish & Richardson P.C.

(57) ABSTRACT

An induction heating device includes: a first board including a first working coil, a first inverter configured to apply a resonant current to the first working coil, a first current transformer configured to adjusting a magnitude of the first resonant current, a first control unit configured to control the first inverter; and a second board including a second working coil, a second inverter configured to apply a resonant current to the second working coil, a second current transformer configured to adjust a magnitude of the second resonant current, a first relay configured to selectively connect the second working coil to the second current transformer or to the first working coil, a second relay configured to selectively connect the second working coil to the first working coil or to the second resonant capacitor, and a second control unit configure to control the second inverter, the first relay, and the second relay.

20 Claims, 9 Drawing Sheets

(58) Field of Classification Search
CPC ..... H05B 6/1281; H05B 6/1272; H05B 2206/022; H05B 2213/05
USPC ..... 219/620, 621, 624, 662, 664, 671
See application file for complete search history.

(56) References Cited

U.S. PATENT DOCUMENTS

| | | | | |
|---|---|---|---|---|
| 2010/0206867 | A1* | 8/2010 | Acero Acero ..... | H05B 6/1272<br>219/468.1 |
| 2016/0150597 | A1* | 5/2016 | Yun ..... | H05B 6/065<br>219/624 |

FOREIGN PATENT DOCUMENTS

| | | | | |
|---|---|---|---|---|
| JP | 2015228351 | | 12/2015 | |
| JP | 2015228351 | A * | 12/2015 | ..... Y02B 40/00 |
| KR | 1020110009544 | | 1/2011 | |
| WO | WO2011080642 | | 7/2011 | |

* cited by examiner

INDUCTION HEATING DEVICE HAVING IMPROVED CONTROL ALGORITHM AND CIRCUIT STRUCTURE

CROSS-REFERENCE TO RELATED APPLICATIONS

This application claims the priority of Korean Patent Application No. 10-2018-0056189 filed on May 16, 2018, in the Korean Intellectual Property Office, the disclosure of which is hereby incorporated by reference in its entirety.

BACKGROUND

1. Technical Field

The present disclosure relates to an induction heating device having an improved control algorithm and an improved circuit structure.

2. Description of the Related Art

In homes and restaurants, cooking utensils using various heating methods to heat food are being used. Conventionally, gas ranges using gas as fuel have been widely used. However, in recent years, there has been a spread of devices for heating a cooking vessel such as a loaded object, such as a pot, by using electricity without using gas.

A scheme of heating a loaded object using electricity is divided into a resistive heating type and an inductive heating type. In the electrical resistive heating method, heat generated when current flows through a metal resistance wire or a non-metallic heating element such as silicon carbide is transmitted to the loaded object through radiation or conduction, thereby heating the loaded object. In the inductive heating method, when a high-frequency power of a predetermined magnitude is applied to the working coil, an eddy current is generated in the loaded object made of a metal by using a magnetic field generated around the working coil so that the loaded object itself is heated. The principle of the induction heating scheme is as follows. First, as power is applied to the induction heating device, a high-frequency voltage of a predetermined magnitude is applied to the working coil. Accordingly, an inductive magnetic field is generated around the working coil disposed in the induction heating device. When the flux of the inductive magnetic field thus generated passes through a bottom of the loaded object containing the metal as loaded on the induction heating device, an eddy current is generated inside the bottom of the loaded object. When the resulting eddy current flows in the bottom of the loaded object, the loaded object itself is heated.

The induction heating device generally has each working coil in each corresponding heated region to heat each of a plurality of objects (e.g., a cooking vessel).

In this connection, in order to operate multiple working coils concurrently, the corresponding working coils are arranged in a flex zone arrangement (in which two or more working coils are arranged side by side and operate simultaneously) or a dual zone arrangement (in which two or more working coils are arranged in a concentric manner and operate simultaneously).

Furthermore, in recent years, a zone free-based induction heating device has been widely used in which a plurality of working coils are evenly distributed over an entire region of the induction heating device (i.e., an entire region of a cooktop). For such a zone-free based induction heating device, when an object to be heated is loaded on a region corresponding to a plurality of working coil regions, the object may be inductively heated regardless of the size and position of the object.

In this connection, referring to FIG. 1 to FIG. 3, a conventional induction heating device having a plurality of working coils is illustrated. Referring to the drawings, a conventional induction heating device will be described.

FIG. 1 through FIG. 3 are circuit diagrams illustrating a conventional induction heating device.

First, as illustrated in FIG. 1, in the conventional induction heating device 10, directions of currents supplied to the plurality of working coils WC1 and WC2 are the same. Further, there is no circuit configuration capable of reversing or switching the direction of the current input/output to/from the working coils.

Due to this circuit structure, when implementing a flex mode (i.e., a concurrent operation mode of a plurality of working coils WC1 and WC2) or a high output mode, the working coils WC1 and WC2 must be controlled at an in-phase and at the same frequency. This may lead to a problem that the heated region is concentrated on the edges of the working coils WC1 and WC2 and, hence, the heated region of the object is limited to the region corresponding to the edges of the working coils WC1 and WC2.

Further, in the conventional induction heating device 10, an object-detection process is individually performed for each working coil WC1 and WC2. Thus, when the object is located on a region corresponding to an area between the first and second working coils WC1 and WC2, the device may not accurately detect whether the object is disposed on the first working coil WC1. In this case, even when the induction heating device 10 is set to the flex mode, the device cannot correctly execute the flex mode.

On the other hand, as illustrated in FIG. 2, a conventional induction heating device 11 allows one inverter (for example, first inverter IV1 or second inverter IV2) to synchronize a plurality of working coils WC1 to WC5 via relays R1 to R7. Therefore, when operating in the flex mode, a plurality of working coils WC1 to WC5 may be connected to one inverter IV1 or IV2 via the relays R1 to R7.

However, in the induction heating device 11 of FIG. 2, the directions of the currents supplied to the plurality of working coils WC1 to WC5 are the same. In this connection, there is no circuit configuration that allows inverting or switching the direction of the current input and output to and from the working coil.

Due to such a circuit structure, there is a limit in that, when at least two of the plurality of working coils WC1 to WC5 operate concurrently in the flex mode, the working coils WC1 to WC5 may be controlled only at an in-phase and at the same frequency. Further, a separate bridge diode is needed for high output implementation.

In the conventional induction heating device 11, an object-detection process is performed individually for each working coil WC1 to WC5. Thus, for example, when an object is located in a region corresponding to a position between the first and second working coils WC1 and WC2, the device may not accurately detect whether the object is disposed on the first working coil WC1. In this case, even when the induction heating device 11 is set to the flex mode, the device 11 cannot correctly execute the flex mode.

Finally, a conventional induction heating device 12 as illustrated in FIG. 3 may have the same problem as the induction heating device 10 in FIG. 1.

That is, in the induction heating device 12 of FIG. 3, the directions of the currents supplied to the plurality of working coils WC1 to WC4 are the same. In this connection, there is no circuit configuration that allows inverting or switching the direction of the current input and output to and from the working coil. Further, in the conventional induction heating device 13, an object-detection process is performed individually for each working coil WC1 to WC4.

The circuit structure and object-detection method as described above may lead to following defects: when the device operates in the flex mode, corresponding working coils may be controlled only at an in-phase and at the same frequency; further, when an object is located on a region corresponding to an area between the working coils, the flex mode is not implemented properly; further, realizing a high output performance requires a separate bridge diode or a separate synchronization scheme.

SUMMARY

A purpose of the present disclosure is to provide an induction heating device employing an improved object-detection algorithm for the flex mode operation (that is, for concurrent operations of multiple working coils).

Further, another purpose of the present disclosure is to provide an induction heating device with improved heating-region control and improved output control by means of an improved circuit structure.

The purposes of the present disclosure are not limited to the above-mentioned purposes. Other purposes and advantages of the present disclosure, as not mentioned above, may be understood from the following descriptions and more clearly understood from the embodiments of the present disclosure. Further, it will be readily appreciated that the objects and advantages of the present disclosure may be realized by features and combinations thereof as disclosed in the claims.

The induction heating device according to the present disclosure may include a main control unit for determining whether to enable a flex mode, based on an individual coil-based object-detection result for each of the plurality of working coils, and based on a coil set-based object-detection result for a set of the plurality of working coils. This may improve the object-detection algorithm when the device is in the flex mode.

Further, the induction heating device according to the present disclosure includes a circuit configuration that may invert or switch the direction of the current as is input and output to and from the working coil. This allows the device to improve heating-region control and output control.

In the induction heating device according to the present disclosure, the object-detection algorithm when the device is running in the flex mode may be improved. Thus, the user may easily check whether an object on an area corresponding to an area between the working coils is correctly positioned for enablement of the flex mode. Thus, a burden that the user should place the object on a correct position for driving of the induction heating device in the flex mode may be eliminated. Thus, user convenience may be improved.

Further, in the induction heating device according to the present disclosure, an improved circuit structure may improve heating-region control and output control. This reduces the object heating time and improves the accuracy of the heating intensity adjustment. Further, the object heating time reduction, and improved heating intensity adjustment accuracy may result in shorter cooking timing by the user, thereby resulting in improved user satisfaction.

Further specific effects of the present disclosure as well as the effects as described above will be described in conduction with illustrations of specific details for carrying out the invention.

DETAILED DESCRIPTION

Figure 1:
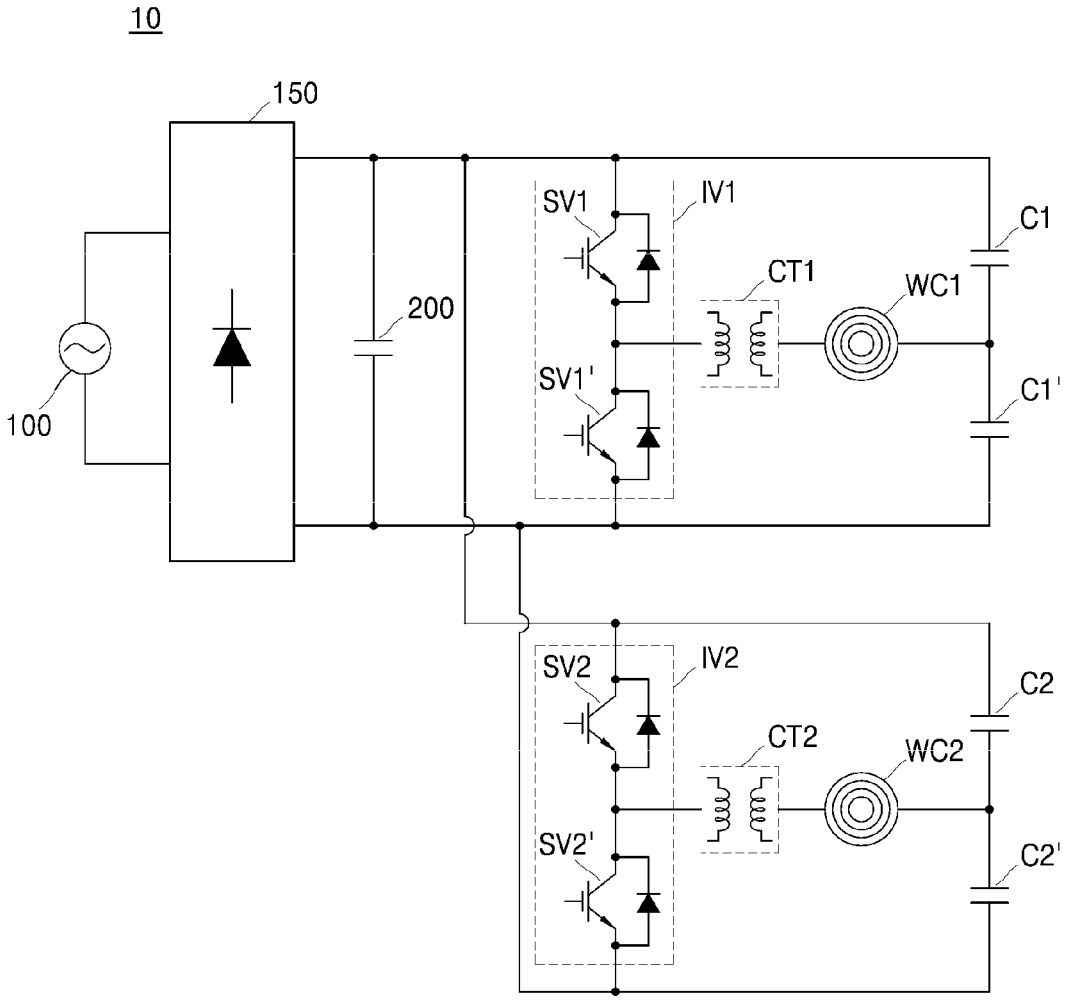
FIG. 1 to FIG. 3 are circuit diagrams illustrating a conventional induction heating device.
Figure 2:
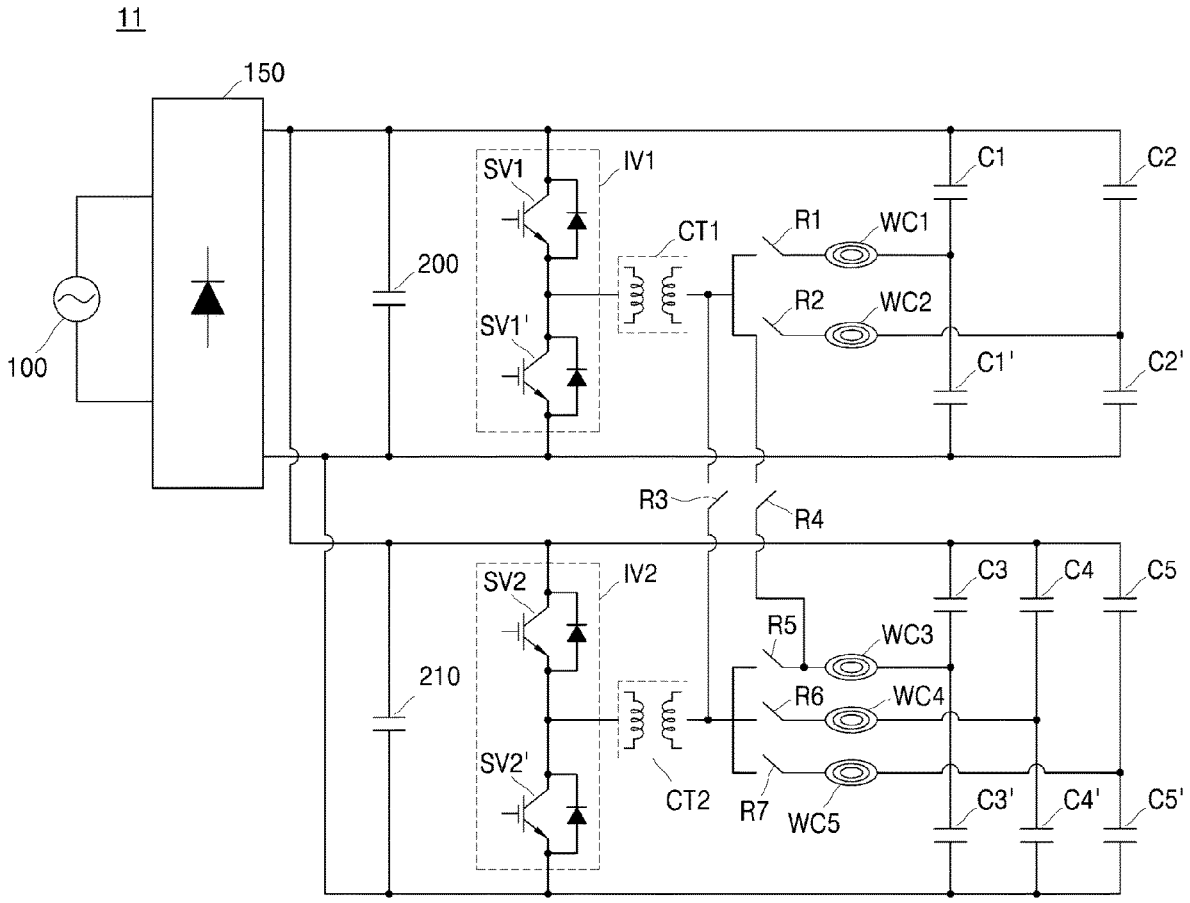
Figure 3:
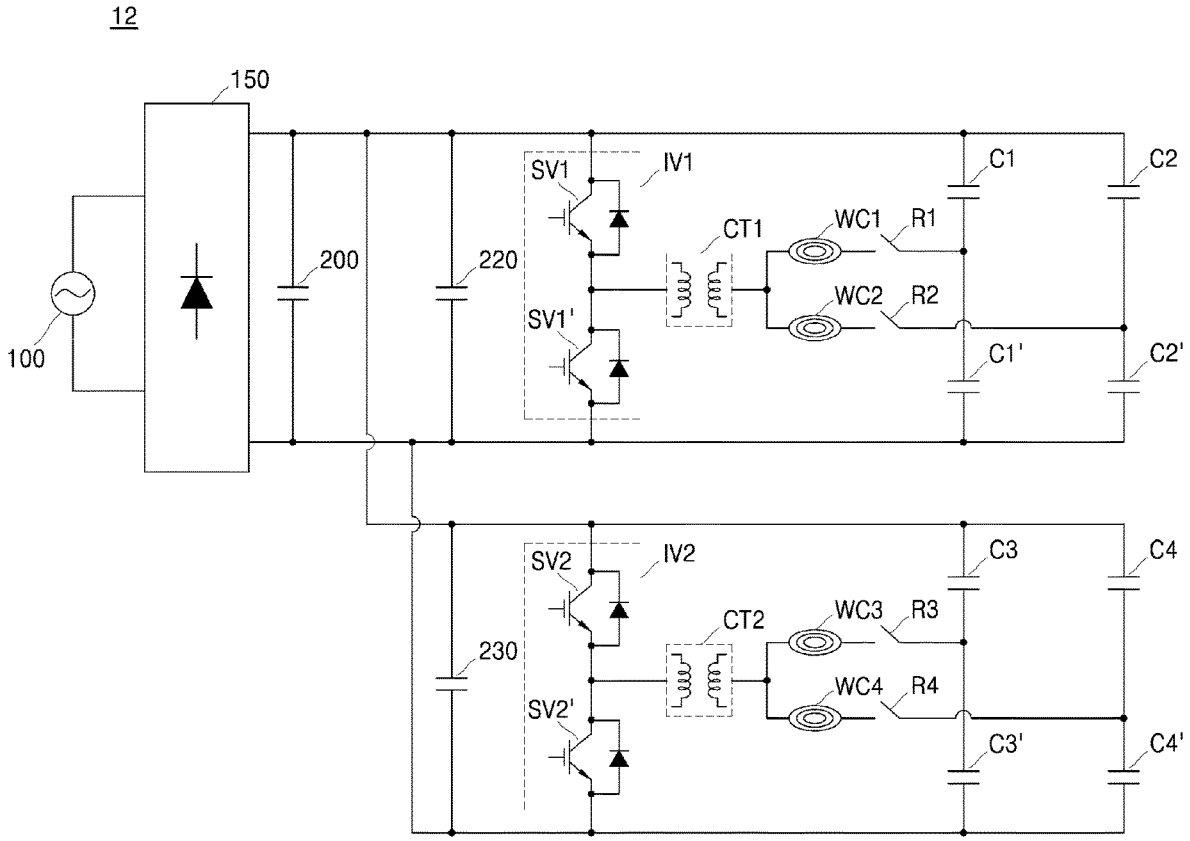

The above objects, features and advantages will become apparent from the detailed description with reference to the accompanying drawings. Embodiments are described in sufficient detail to enable those skilled in the art in the art to easily practice the technical idea of the present disclosure. Detailed descriptions of well-known functions or configurations may be omitted in order not to unnecessarily obscure the gist of the present disclosure. Hereinafter, embodiments of the present disclosure will be described in detail with reference to the accompanying drawings. Throughout the drawings, like reference numerals refer to like elements.

Figure 4:
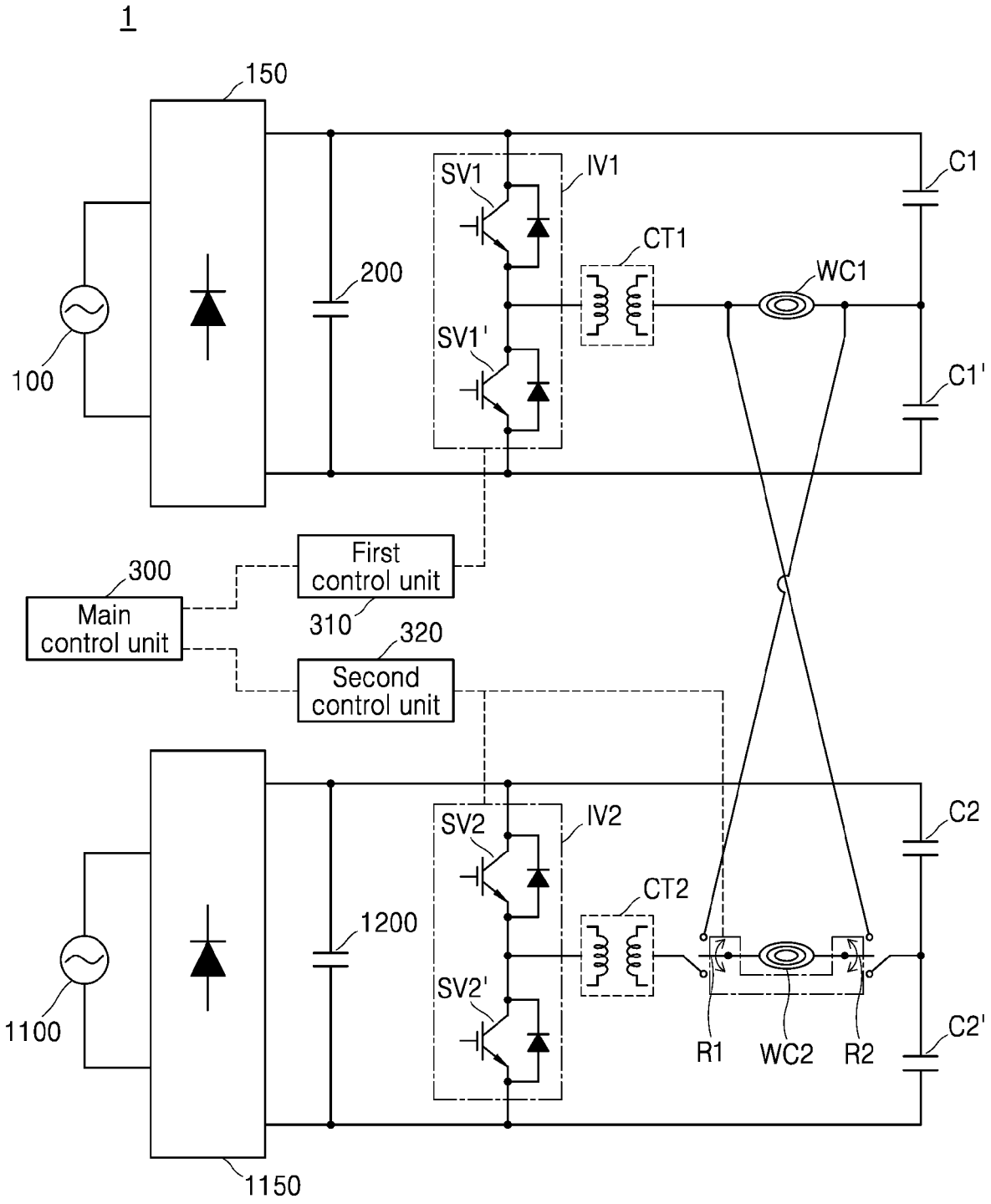
FIG. 4 is a circuit diagram illustrating an induction heating device according to one embodiment of the present disclosure.

FIG. 4 is a circuit diagram showing an induction heating device according to one embodiment of the present disclosure.

Referring to FIG. 4, an induction heating device 1 according to the present disclosure includes a first board (not shown) having, thereon, a first power supply 100, a first rectifier 150, a first direct-current (DC) link capacitor 200, a first inverter IV1, a first current transformer CT1, a first working coil WC1, a first resonant capacitor set C1 and C1', and a first control unit 310; and a second board (not shown) having, thereon, a second power supply 1100, a second rectifier 1150, a second direct-current (DC) link capacitor 1200, a second inverter IV2, a second current transformer CT2, a second working coil WC2, a second resonant capacitor set C2 and C2', first and second relays R1 and R2, and a second control unit 320.

In one embodiment, although not illustrated in the drawing, each of the first and second boards may be implemented, for example, in a form of a printed circuit board (PCB). The induction heating device 1 may further include a main control unit 300 and an input interface (not shown).

In this connection, the first control unit 310 may control operations of various components (e.g., the first inverter IV1, etc.) on the first board. The second control unit 320 may control operations of various components (e.g., the second inverter IV2, the first and second relays R1 and R2, etc.) on the second board.

Further, the input interface may be a module that allows a user to input a target heating intensity or a target driving time of the induction heating device. The input interface may be implemented in a various manner including a physical button or a touch panel. The user interface may receive the input from the user and provide the input to the main control unit 300. Then, the main control unit 300 may supply the input received from the input interface to at least one of the first and second control units 310 and 320.

Accordingly, the first control unit 310 controls an operation of the first inverter IV1 based on the input received from the main control unit 300, while the second control unit 320 may control operations of the second inverter IV2 and the first and second relays R1 and R2, respectively, based on the input received from the main control unit 300.

However, for convenience of illustration, a more specific example of the input interface may be omitted. Details of the first and second control units 310 and 320 and the main control unit 300 will be described later.

Further, the number of components (for example, inverters, working coils, relays, current transformers, etc.) of the induction heating device as illustrated in FIG. 4 may vary. For convenience of illustration, an example of the induction heating device 1 having the number of components as illustrated in FIG. 4 will be described below. Further, the components disposed on the first board and the components disposed on the second board are the same, except for the presence or absence of the first and second relays R1 and R2. Therefore, the components disposed on the first board will be exemplified below.

First, the first power supply 100 may output alternate-current (AC) power.

Specifically, the first power supply 100 may output the alternate-current (AC) power to the first rectifier 150. For example, the AC power may be a commercial power source.

The first rectifier 150 may convert the alternate-current (AC) power supplied from first power supply 100 to direct-current (DC) power and supply the DC power to the first inverter IV1.

Specifically, the first rectifier 150 may rectify the alternate-current (AC) power supplied from the first power supply 100 to convert the AC power to the direct-current (DC) power.

Further, the direct-current (DC) power rectified by the first rectifier 150 may be provided to the first direct-current (DC) link capacitor 200 (that is, a smoothing capacitor) connected in parallel with the first rectifier 150. The first direct-current (DC) link capacitor 200 may reduce a ripple in the direct-current (DC) power.

In one embodiment, the first direct-current (DC) link capacitor 200 may be connected in parallel to the first rectifier 150 and first inverter IV1. Further, the direct-current (DC) voltage may be applied to one end of the direct-current (DC) link capacitor 200, while the other end of the first direct-current (DC) link capacitor 200 may be connected to a ground.

Alternatively, although not illustrated in the figure, the direct-current (DC) power rectified by the first rectifier 150 may be provided to a filter (not shown) rather than to the direct-current (DC). The filter may remove an alternate-current (AC) component from the direct-current (DC) power.

However, in the induction heating device 1 according to one embodiment of the present disclosure, an example in which the direct-current (DC) power rectified by the first rectifier 150 is provided to the direct-current (DC) will be exemplified below.

The first inverter IV1 may perform a switching operation to apply a resonant current to the first working coil WC1.

Specifically, the switching operation for the first inverter IV1 may be controlled by the first control unit (310) as described above. That is, the first inverter IV1 may perform the switching operation based on a switching signal (i.e., a control signal, also referred to as a gate signal) received from the control unit.

In one embodiment, the first inverter IV1 may include two switching elements SV1 and SV1'. The two switching elements SV1 and SV1' may alternatively be turned on and off in response to the switching signal received from the first control unit (310).

Further, alternating-current (AC) (i.e., resonant current) having a high frequency may be generated by the switching operation of the two switching elements SV1 and SV1'. Then, the generated high-frequency alternate-current (AC) may be applied to the first working coil WC1.

The first working coil WC1 may receive the resonant current from the first inverter IV1. The first working coil WC1 may be connected to the first resonant capacitor set C1 and C1'.

Further, the high-frequency alternate-current (AC) applied from the first inverter IV1 to the first working coil WC1 may enable an eddy current to be generated between the first working coil WC1 and an object (for example, a cooking vessel), so that the object may be heated.

The first current transformer CT may vary a magnitude of the resonant current as output from the first inverter IV1 and transfer the resonant current with the varied magnitude to the first working coil WC1.

Specifically, the first current transformer CT may include a primary stage connected to the first inverter IV1 and a secondary stage connected to the first working coil WC1. Based on a transforming ratio between the primary stage and the secondary stage, the magnitude of the resonant current delivered to the first working coil WC1 may be varied.

For example, when a coil-turns ratio between the primary and secondary stages is 1:320, a magnitude (for example, 80 A) of the resonant current flowing in the primary stage may be reduced by 1/320 to a magnitude (for example, 0.25 A).

In one embodiment, the first current transformer CT may be used to reduce the magnitude of the resonant current flowing in the first working coil WC1 to a magnitude measurable by the first control unit 310.

The first resonant capacitor set C1 and C1' may be connected to the first working coil WC1.

Specifically, the first resonant capacitor set C1 and C1' may include a first resonant capacitor C1 and a first further resonant capacitor C1' as connected in series with each other. The first resonant capacitor set C1 and C1' may form a first resonant circuit together with the first working coil WC1.

Further, the first resonant capacitor set C1 and C1' starts to resonate when a voltage is applied thereto via the switching operation of the first inverter IV1. In response, when the first resonant capacitor set C1 and C1' resonates, the current flowing through the first working coil WC1 connected to the first resonant capacitor set C1 and C1' may increase.

In this way, an eddy current may be induced to the object disposed on the first working coil WC1 connected to the first resonant capacitor set C1 and C1'.

In a similar manner to the first board as described above, the second board may have the same components thereon (e.g., the second power supply 1100, the second rectifier 1150, the second direct-current (DC) link capacitor 1200, the second inverter IV2 including two switching elements SV2 and SV2', the second current transformer CT2, the second working coil WC2, the second resonant capacitor set C2 and C2', and the second control unit 320). Details about this may be omitted.

However, on the second board, the first and second relays R1 and R2 may be further disposed for an inversion circuit configuration.

Specifically, the first relay R1 may selectively connect one end of the second working coil WC2 to the second current transformer CT2 or one end of the first working coil WC1. The first relay R1 may be controlled by the second control unit 320 as described above.

Specifically, one end of the first relay R1 may be selectively connected to the second current transformer CT2 or one end of the first working coil WC1, while the other end thereof may be connected to one end of the second working coil WC2.

Details of the selective opening/closing operation of the first relay R1 will be described later.

The second relay R2 may selectively connect the other end of the second working coil WC2 to the other end of the first working coil WC1 or the second resonant capacitor set (i.e., the second resonant capacitor C2 and second further resonant capacitor C2'). The second relay R2 may be controlled by the second control unit 320 as described above.

Specifically, one end of the second relay R2 may be selectively connected to the other end of the first working coil WC1 or second resonant capacitor set C2 and C2', while the other end thereof may be connected to the other end of the second working coil WC2.

Details of the selective opening/closing operation of the second relay R2 will be described later.

In one embodiment, in addition to the first and second relays R1 and R2, two further relays may be located at both ends of the first working coil WC1 respectively. The further relays may also operate on the same principle as the first and second relays R1 and R2. However, for convenience of illustration, in this embodiment of the present disclosure, an example that the first and second relays R1 and R2 are disposed at both ends of the second working coil WC2 respectively will be exemplified below.

In one embodiment, the main control unit 300 may receive an input from a user via the input interface. Then, the received input may be provided as at least one of the first and second control units 310 and 320. Further, the first control unit 310 may control the operation of the first inverter IV1 based on the input as received from the main control unit 300, while the second control unit 320 may control operations of the second inverter IV2 and the first and second relays R1 and R2, respectively, based on the input as received from the main control unit 300.

The main control unit 300 may exchange information (for example, information related to working coil detection, control-related commands or data, etc.) via communicating with the first and second control units 310 and 320.

Further, the main control unit 300 may determine whether to operate the first and second working coils WC1 and WC2 concurrently, based on the input of the user received from the input interface and the information as received from the first and second control units 310 and 320.

Specifically, when the user's input as received from the input interface indicates a concurrent operation of the first and second working coils WC1 and WC2, the main control unit 300 may determine whether to operate the first and second working coils WC1 and WC2 concurrently, based on an individual coil-based object-detection result for each of the first and second working coils WC1 and WC2, and based on a coil set-based object-detection result for a set of the first and second working coils WC1 and WC2, respectively.

Further, when the concurrent operation of the first and second working coils WC1 and WC2 is determined, the main control unit 300 supplies a control command related to the concurrent operation to the first and second control units 310 and 320. In response, the first and second control units 310 and 320 may realize the concurrent operation of the first and second working coils WC1 and WC2, based on the control command as received from the main control unit 300.

In one embodiment, when the first and second working coils WC1 and WC2 operate concurrently, this concurrent operation may achieve a higher power than that from the individual operation. Further, the main control unit 300 may receive information related to the individual coil-based object-detection and to the coil set-based object detection from the first and second control units 310 and 320.

The object-detection method, and the method for determining whether or not to execute the concurrent operation will be described later in detail.

In one embodiment, when the user's input received from the input interface indicates an individual operation between the first and second working coils WC1 and WC2, the first and second control units 310 and 320 may control the individual operations between the first and second working coils WC1 and WC2 based on the user's input as received from the main control unit 300.

Specifically, the first control unit 310 may determine whether to individually operate the first working coil WC1 based on the individual coil-based object-detection result for the first working coil WC1, while the second control unit 320 may determine whether to operate the second working coil WC2 individually based on the individual coil-based object-detection result for the second working coil WC2.

That is, when an object is detected on the first working coil WC1, the first control unit 310 drives the first working coil WC1. When no object is detected on the first working coil WC1, the first control unit 310 does not drive the first working coil WC1.

In the same principle, the second control unit 320 drives the second working coil WC2 when an object is detected on the second working coil WC2. When no object is detected on the second working coil WC2, the second control unit 320 does not drive the second working coil WC2.

In this manner, the first control unit 310 may control the operation of the first inverter IV1 based on the input received from the main control unit 300, while the second control unit 320 may control the operations of the second inverter IV2 and the first and second relays R1 and R2, respectively, based on the input as received from the main control unit 300.

Further, the first and second control units 310 and 320 may determine whether to heat a region corresponding to a region between the first and second working coils WC1 and WC2, based on the user's input received from main control unit 300. Details of this will be described later.

The induction heating device 1 according to one embodiment of the present disclosure may also have a wireless power transfer function, based on the configurations and features as described above.

That is, in recent years, a technology for supplying power wirelessly has been developed and applied to many electronic devices. An electronic device with the wireless power transmission technology may charge a battery by simply placing the battery on a charging pad without connecting the battery to a separate charging connector. An electronic device to which such a wireless power transmission is applied does not require a wire cord or a charger, so that portability thereof is improved and a size and weight of the electronic device are reduced compared to the prior art.

Such a wireless power transmission system may include an electromagnetic induction system using a coil, a resonance system using resonance, and a microwave radiation system that converts electrical energy into microwave and transmits the microwave. The electromagnetic induction system may execute wireless power transmission using an electromagnetic induction between a primary coil (for example, the first and second working coils WC1 and WC2) provided in a unit for transmitting wireless power and a secondary coil included in a unit for receiving the wireless power.

The induction heating device 1 heats the loaded-object via electromagnetic induction. Thus, the operation principle of the induction heating device 1 may be substantially the same as that of the electromagnetic induction-based wireless power transmission system.

Therefore, the induction heating device 1 according to one embodiment of the present disclosure may have the wireless power transmission function as well as induction heating function. Furthermore, an induction heating mode or a wireless power transfer mode may be controlled by the main control unit (300). Thus, if desired, the induction heating function or the wireless power transfer function may be selectively used.

The induction heating device 1 may have the configuration and features described above. Hereinafter, with reference to FIGS. 5 to 8, a relay switching method using the induction heating device 1 will be described.

Figure 5:
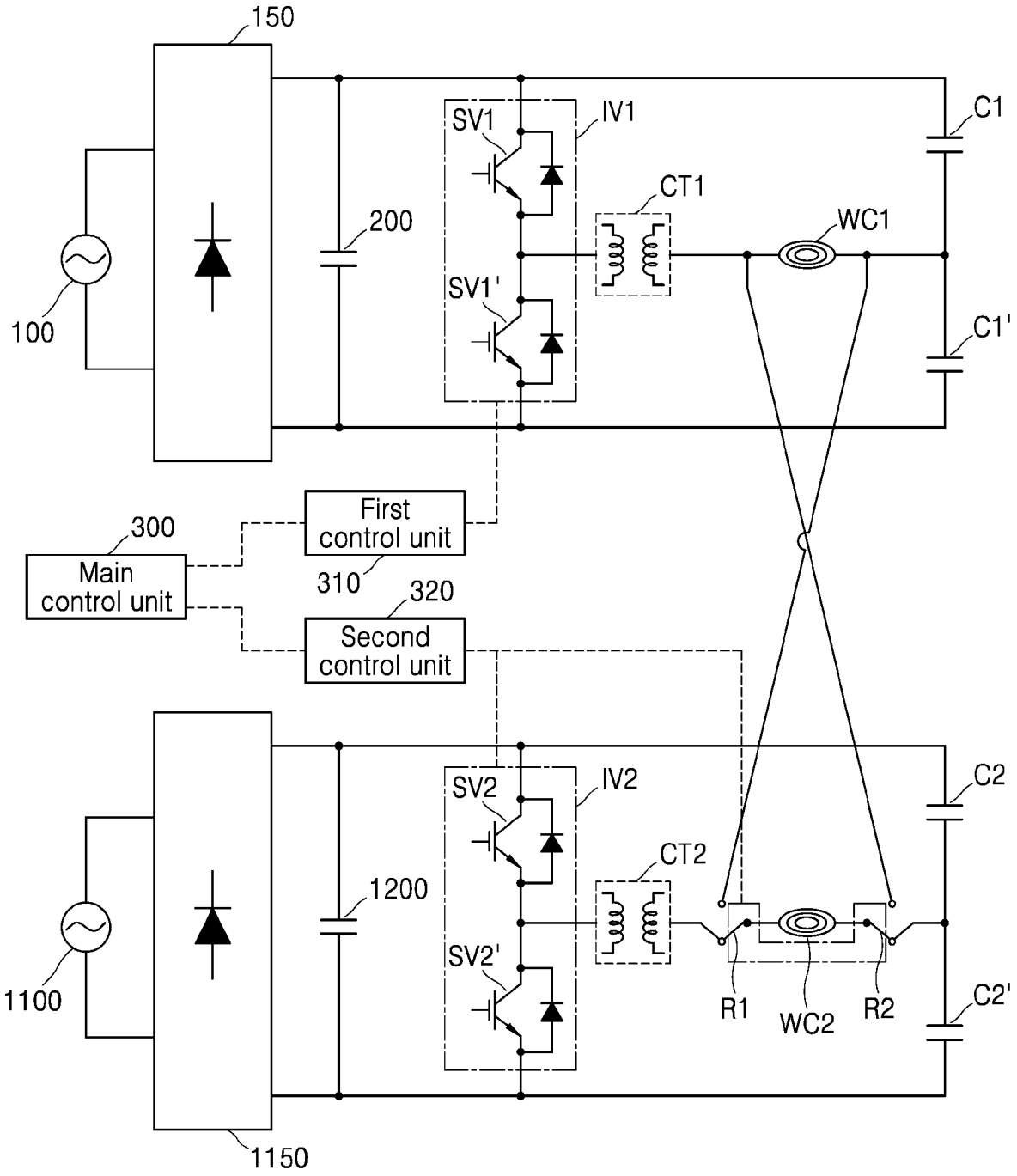
FIG. 5 is a circuit diagram illustrating one example of a relay switching method by an induction heating device of FIG. 4.
Figure 6:
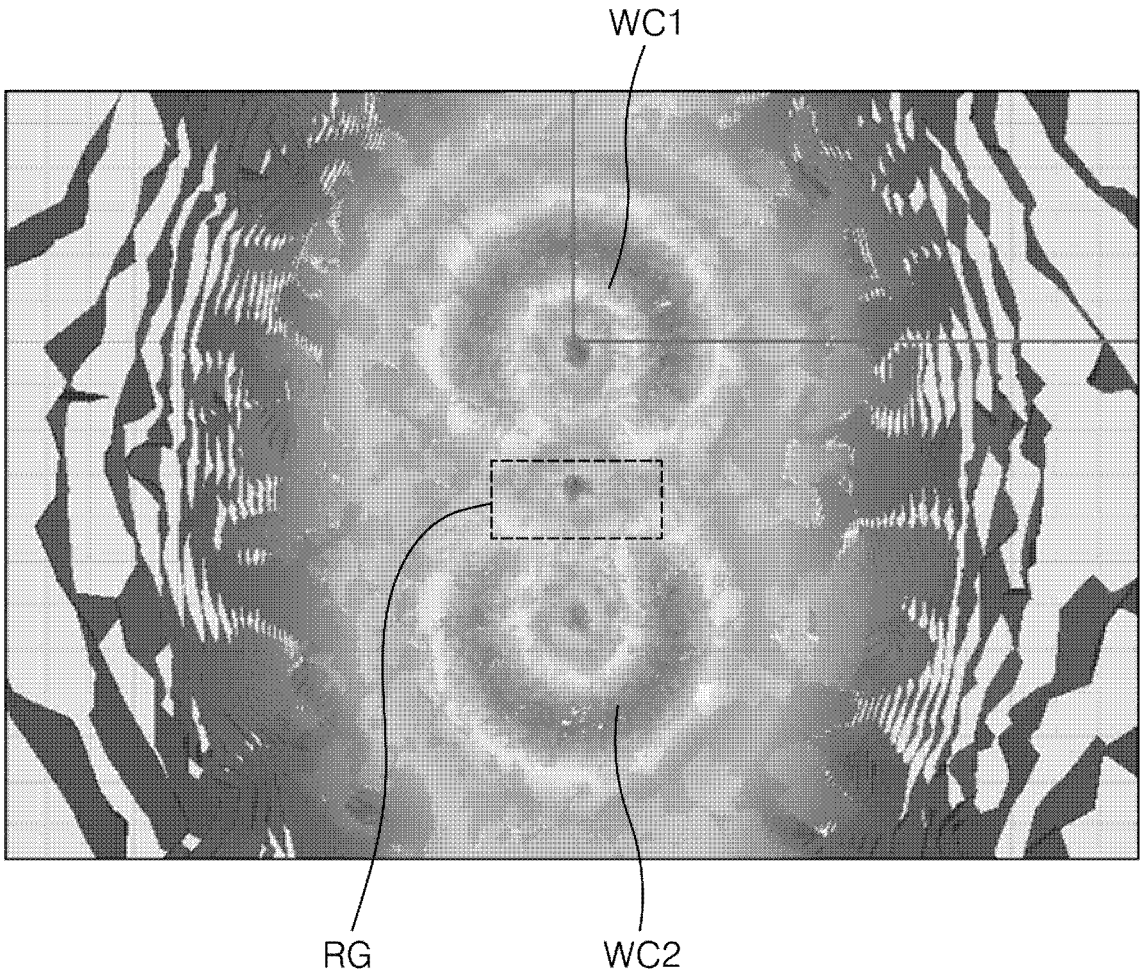
FIG. 6 is a schematic diagram illustrating a heating-region by working coils according to the relay switching method of FIG. 5.
Figure 7:
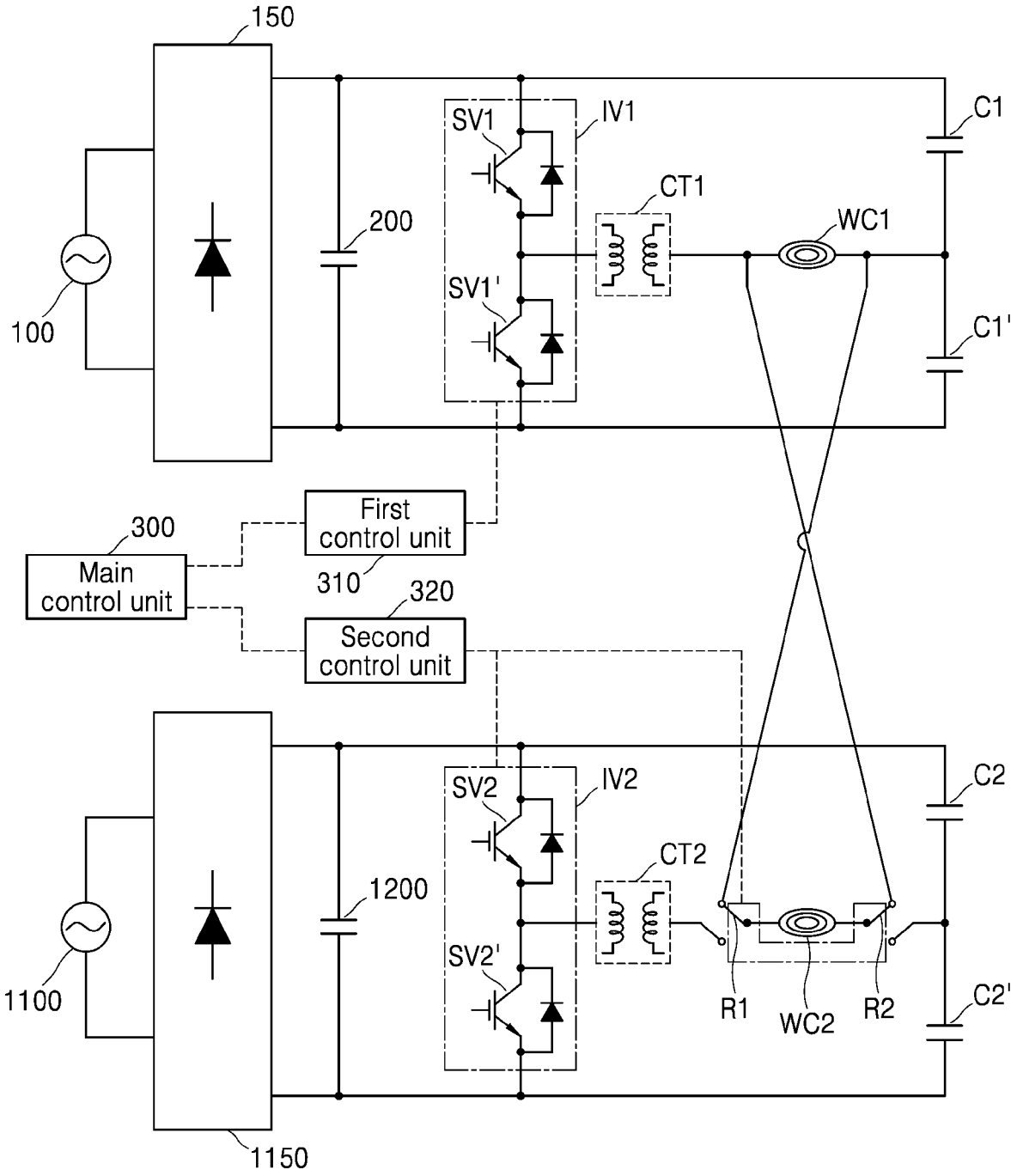
FIG. 7 is a circuit diagram illustrating another example of a relay switching method by an induction heating device of FIG. 4.
Figure 8:
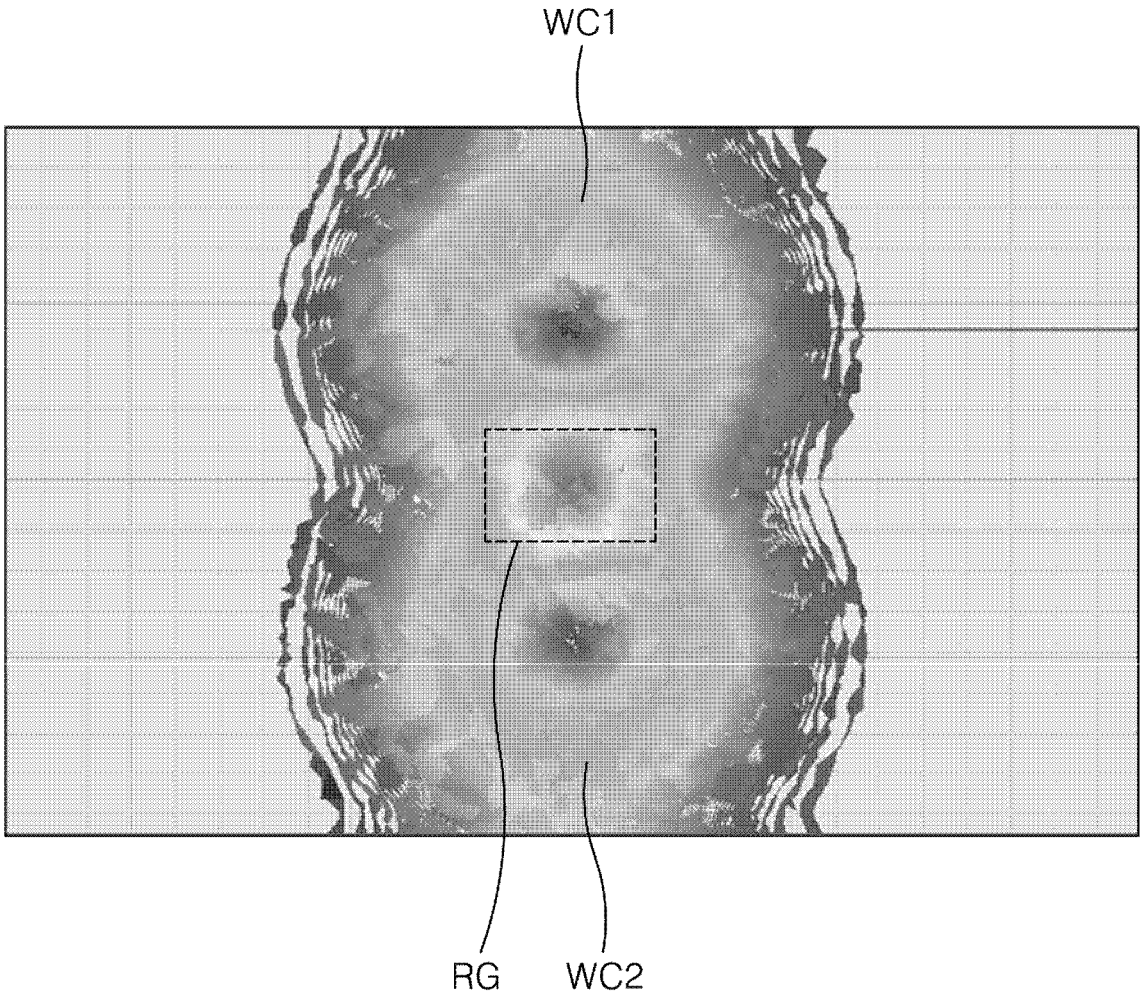
FIG. 8 is a schematic diagram illustrating a heating-region by working coils according to the relay switching method of FIG. 7.

FIG. 5 is a circuit diagram illustrating one example of a relay switching method by the induction heating device of FIG. 4. FIG. 6 is a schematic diagram illustrating a heating-region by working coils according to the relay switching method of FIG. 5. FIG. 7 is a circuit diagram illustrating another example of a relay switching method by the induction heating device of FIG. 4. FIG. 8 is a schematic diagram illustrating a heating-region by working coils according to the relay switching method of FIG. 7.

First, referring to FIG. 5, the first and second control units 310 and 320 may determine whether or not to heat a region corresponding to a region between the first and second working coils WC1 and WC2 based on the user input as received from the main control unit 300.

Specifically, when the input provided by the user to the input interface indicates the region between the first and second working coils WC1 and WC2 as a non-target heated region (for example, a poorly-heated region), the first control unit 310 may drive the first inverter IV1, while the second control unit 320 may drive the second inverter IV2. In this connection, the second control unit may control the first relay R1 to connect one end of the second working coil WC2 to the second current transformer CT2, and may control the second relay R2 to connect the other end of the second working coil WC2 to the second resonant capacitor set C2 and C2'.

That is, one end of the first relay R1 may be connected to the second current transformer CT2, while one end of second relay R2 may be connected to second resonant capacitor set C2 and C2'.

When the first and second relays R1 and R2 are connected as described above, the directions of the currents (for example, the resonant currents) input and output respectively to and from the first and second working coils WC1 and WC2 may be the same. Therefore, since the first and second working coils WC1 and WC2 may be driven at an in-phase and at the same frequency, heating is concentrated on the region corresponding to the edges of the working coils WC1 and WC2. Thereby, heat may be concentrated on a region of the object corresponding to the edges of the working coils WC1 and WC2.

That is, when the first and second working coils WC1 and WC2 are driven at the same frequency and phase, the region corresponding to the region between the first and second working coils WC1 and WC2 may be set to a non-target heated region. Regions corresponding to remaining edges of the first and second working coils WC1 and WC2, except for the non-target heated region may be heated by the first and second working coils WC1 and WC2.

In this connection, referring to FIG. 6, heating is concentrated on the regions corresponding to the edges of the working coils WC1 and WC2. The region RG corresponding to the region between the first and second working coils WC1 and WC2 may set to be a non-target heated region (i.e., a poorly-heated region).

In one embodiment, although the region RG corresponding to the region between the first and second working coils WC1 and WC2 is set to the non-target heated region, the first and second inverters IV1 and IV2 are all driven, so that high power may be achieved.

On the other hand, referring to FIG. 7, when the input provided by the user to the input interface indicates the region corresponding to the region between the first and second working coils WC1 and WC2 as the target heated region, the first control unit 310 may drive the first inverter IV1 while the second control unit 320 may not drive the second inverter IV2. In this connection, the second control unit 320 may control the first relay R1 to connect one end of the second working coil WC2 and one end of the first working coil WC1, while the second control unit 320 may control the second relay R2 to connect the other end of the second working coil WC2 to the other end of the first working coil WC1.

That is, one end of the first relay R1 may be connected to one end of the first working coil WC1, while one end of the second relay R2 may be connected to the other end of the first working coil WC1.

When the first and second relays R1 and R2 are connected as described above, the directions of the currents (e.g., resonant currents) input/output to/from the first and second working coils WC1 and WC2 may be switched (i.e., inverted). That is, the first working coil WC1 may be driven at the same frequency as the second working coil WC2 but at an out-of-phase by 180 degrees from a phase of the second working coil. Thus, heating is concentrated on the region corresponding to the region between the working coils WC1 and WC2. The heating-concentrated region of the object may correspond to the region between the working coils WC1 and WC2.

That is, when the first working coil WC1 may be driven at the same frequency as the second working coil WC2 but at an out-of-phase by 180 degrees from a phase of the second working coil, the region corresponding to the region between the working coils WC1 and WC2 may be set to a target heated region, which, in turn, may be primarily heated by the working coils WC1 and WC2.

In this connection, referring to FIG. 8, the region RG corresponding to the region between each working coil WC1 and WC2 may be set to the target heated region. Thus, the heating is concentrated on the corresponding region RG.

When the input provided by the user to the input interface indicates the region corresponding to the region between the first and second working coils WC1 and WC2 as the target heated region, the second control unit 320 does not drive the second inverter IV2. Accordingly, the first inverter IV1 disposed on the first board operates both the first and second working coils WC1 and WC2. Thus, a total output (i.e., total power) may be limited to the output achieved from the first board.

That is, using the above-defined circuit configuration may lead to a following advantage: When the first and second working coils WC1 and WC2 concurrently operate at a 180 degrees out-of-phase from each other, the high power is not achieved, but, a set of the first and second working coils WC1 and WC2 may be integrally controlled as in a control of a single working coil. Thus, the above-described circuit configuration may improve easiness of control (i.e., easiness of control of current and output) of the first and second working coils WC1 and WC2.

In this manner, the induction heating device 1 may improve the heating-region control and the output control by improving the circuit structure.

Hereinafter, an object-detection method by the induction heating device 1 will be described with reference to FIG. 9.

Figure 9:
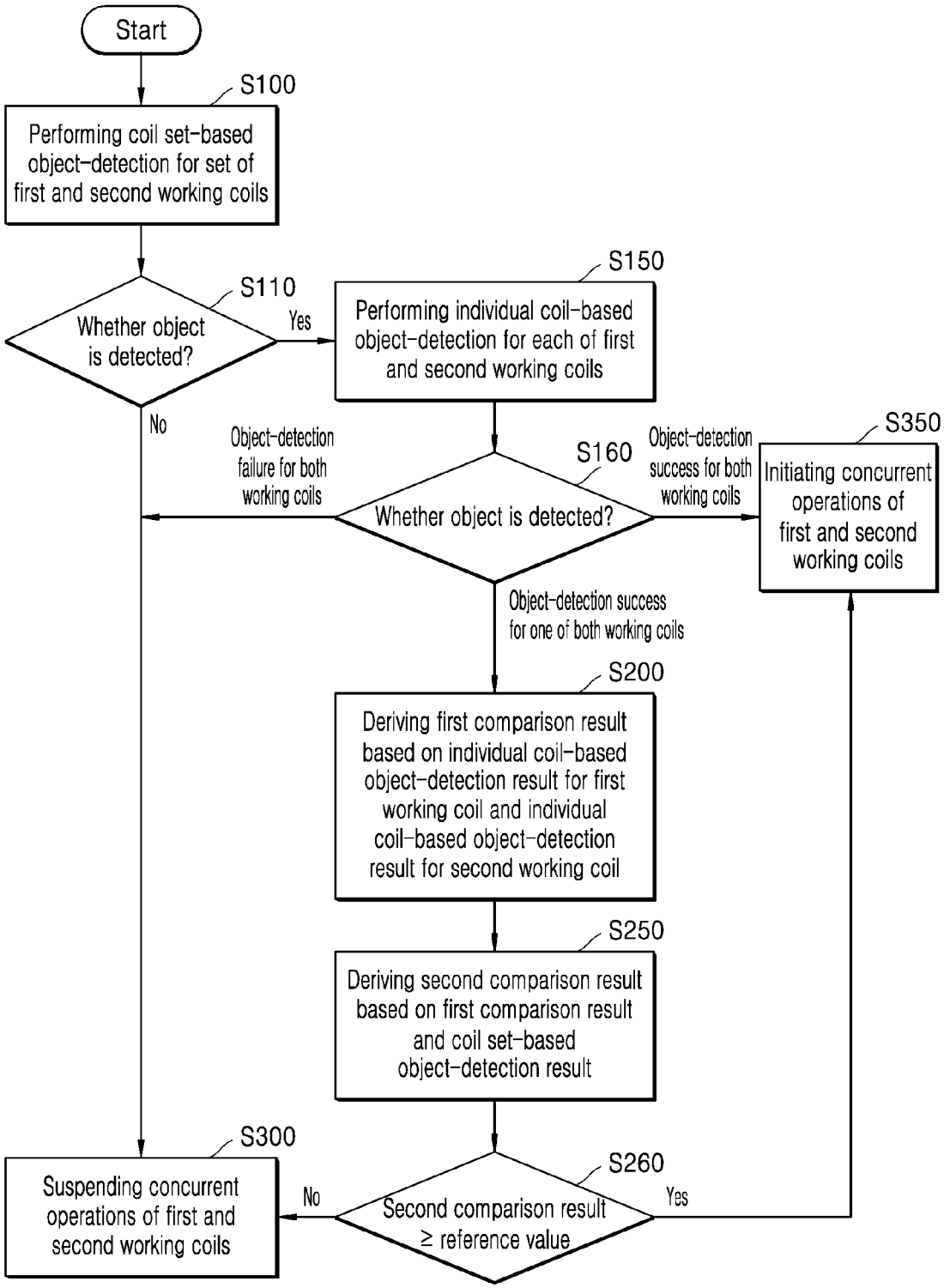
FIG. 9 is a flow chart illustrating an object-detection method by the induction heating device of FIG. 4.

FIG. 9 is a flow chart illustrating an object-detection method by the induction heating device of FIG. 4.

In one embodiment, referring to FIG. 9, an object-detection algorithm is illustrated when the induction heating device 1 is driven in a flex mode.

That is, when the working coils (for example, the first and second working coils WC1 and WC2 of FIG. 4) in the induction heating device 1 are driven in the individual mode, only the individual coil-based object-detection for each of the working coils (e.g., the first and second working coils WC1 and WC2 of FIG. 4) may be performed by the first and second control units 310 and 320.

However, in the flex mode, a different object-detection algorithm may be performed, as illustrated in FIG. 9.

Referring to FIG. 4 and FIG. 9, first, the coil set-based object-detection for the set of the first and second working coils WC1 and WC2 may be performed (S100).

Specifically, when the user input as received by the control unit via the input interface indicates the flex mode (i.e., concurrent operations of the first and second working coils WC1 and WC2), the main control unit 300 together with the first and second control units 310 and 320 may perform the coil set-based object-detection for the set of the first and second working coils WC1 and WC2, In one embodiment, the coil set-based object-detection for the set of the first and second working coils WC1 and WC2 may be performed as follows: a total power consumption of the first and second working coils WC1 and WC2, and a sum of the resonant currents flowing in the first and second working coils WC1 and WC2 may be acquired. Then, the control unit may determine, based on at least one of the total power consumption and the sum of the resonant currents, detect whether or not an object is loaded on the first and second working coils WC1 and WC2.

In other words, when an object is located on a specific working coil (S110), the resistance of the object may increase the overall resistance. As a result, attenuation of the resonant current flowing through the specific working coil may be increased.

The first control unit 310 may detect the resonant current flowing in the first working coil WC1 based on the above-defined principle. Then, the first control unit 310 may calculate at least one of a power consumption and a resonant current of the first working coil WC based on the detected resonant current value. Further, the first control unit 310 may provide the calculation result (i.e., information related to the coil set-based object detection) to the main control unit 300.

In the same manner, the second control unit 320 may detect the resonant current flowing in the second working coil WC2. Then, the second control unit 320 may calculate at least one of a power consumption and a resonant current of the second working coil WC2 based on the detected resonant current value. Further, the second control unit 320 may provide the calculation result (i.e., information related to the coil set-based object detection) to the main control unit 300.

The main control unit 300 may calculate at least one of the total power consumption, and a sum of the resonant currents for the first and second working coils WC1 and WC2, based on the calculation results (i.e., information related to the coil set-based object detection) as respectively received from the first and second control units 310 and 320. Further, the main control unit 300 may detect whether an object is disposed on the first and second working coils WC1 and WC2 based on the calculation result.

Then, when the object is determined not to be detected based on the coil set-based object-detection result for the set of the first and second working coils WC1 and WC2 (S110), the concurrent operations of the first and second working coils WC1 and WC2 may be suspended (S300).

Specifically, when the object is determined not to be detected based on the coil set-based object-detection result for the set of the first and second working coils WC1 and WC2 (S110), the main control unit 300 may determine to disallow the concurrent operations of the first and second working coils WC1 and WC2. In this case, when, subsequently, the user's input (that is, a command for the concurrent operation) is provided via the input interface, the main control unit 300 may perform the above-described detection again based on the corresponding user input.

Conversely, when the object is determined to be detected based on the coil set-based object-detection result for the set of the first and second working coils WC1 and WC2 (S110), the individual coil-based object-detection for each of the first and second working coils WC1 and WC2 may be executed (S150).

Specifically, the individual coil-based object-detection for the first working coil WC1 is performed as follows: whether or not an object exists on the first working coil WC1 may be determined based on the at least one of the resonant current flowing through the first working coil WC1 and the power consumption of the first working coil WC1.

In this connection, the first control unit 310 may perform the individual coil-based object detection for the first working coil WC1. The control unit 310 may provide the individual coil-based object-detection result for the first working coil WC1 (i.e., information related to the individual coil-based object detection) to the main control unit 300.

Further, the individual coil-based object-detection for the second working coil WC2 is performed as follows: whether an object exists on the second working coil WC2 may be determined based on at least one of the resonant current flowing through the second working coil WC2 and a power consumption of the second working coil WC2.

In this connection, the second control unit 310 may perform the individual coil-based object detection for the second working coil WC2. The second control unit 320 may provide the individual coil-based object-detection result for the second working coil WC2 (i.e., information related to the individual coil-based object detection) to the main control unit 300.

When it is determined, based on the individual coil-based object-detection results for the first and second working coils WC1 and WC2 respectively, that the object has not been loaded on both the first and second working coils WC1 and WC2 (S160), the concurrent operations of the first and second working coils WC1 and WC2 may be suspended (S300).

More specifically, when it is determined, based on the individual coil-based object-detection results for the first and second working coils WC1 and WC2 (S160), that the object has not been loaded on both the first and second working coils WC1 and WC2, the main control unit 300 may determine not to operate the first and second working coils WC1 and WC2 concurrently. In this case, when, subsequently, the user's input (that is, a command for the concurrent operation) is provided via the input interface, the control unit may perform the above-described detection again based on the corresponding user input.

Conversely, when it is determined, based on the individual coil-based object-detection results for the first and second working coils WC1 and WC2 (S160), that the object has been loaded on both the first and second working coils WC1 and WC2, the concurrent operations of the first and second working coils WC1 and WC2 may be initiated (S350).

More specifically, when it is determined, based on the individual coil-based object-detection results for the first and second working coils WC1 and WC2 (S160), that the object has been loaded on both the first and second working coils WC1 and WC2, the main control unit 300 may determine to operate the first and second working coils WC1 and WC2 concurrently.

In this case, the main control unit 300 may provide the control command related to the concurrent operation to the first and second control units 310 and 320. Then, the first and second control units 310 and 320 may enable the concurrent operations of the first and second working coils WC1 and WC2 (that is, which concurrently operate either at an in-phase or at a 180-degrees out-of-phase), based on the control command as received from the main control unit 300, Alternatively, when it is determined, based on the individual coil-based object-detection results for the first and second working coils WC1 and WC2 (S160), that the object has been loaded on only one of the first and second working coils WC1 and WC2, the control unit may derive a first comparison result based on an individual coil-based object-detection result for the first working coil WC1 and an individual coil-based object-detection result for the second working coil WC2 (S200).

More specifically, when it is determined, based on the individual coil-based object-detection results for the first and second working coils WC1 and WC2 (S160), that the object has been loaded on only one of the first and second working coils WC1 and WC2, the main control unit 300 may compare the individual coil-based object-detection result (e.g., the power consumption of the first working coil WC1) for the first working coil WC1 and the individual coil-based object-detection result (for example, the power consumption of the second working coil WC2) for the second working coil WC2. This comparison result may be referred to as the first comparison result. For example, based on the first comparison, the power consumption of the first working coil WC1 may be greater than the power consumption of the second working coil WC2.

When the first comparison result has been derived (S200), the main control unit derives a second comparison result based on the first comparison result and the coil set-based object-detection result (S250).

Specifically, the main control unit 300 may derive the second comparison result, based on the coil set-based object-detection result (e.g. the total power consumption of the first and second working coils WC1 and WC2) for the set of the first and second working coils WC1 and WC2, and based on the first comparison result (e.g., the power consumption of the first working coil WC1 being greater than the power consumption of the second working coil WC2). In one example, the second comparison result may be derived via comparison between the total power consumption of the first and second working coils WC1 and WC2 and the power consumption of the first working coil WC1, or may be derived based a difference between the total power consumption of the first and second working coils WC1 and WC2 and the power consumption of the first working coil WC1.

When the second comparison result has been obtained, the control unit determines whether the second comparison result satisfies a predetermined condition (S260).

Specifically, the main control unit 300 compares the second comparison result (e.g., the difference between the total power consumption of the first and second working coils WC1 and WC2 and the power consumption of the first working coil WC1) with a reference value. In this connection, the reference value may mean a minimum or average power consumption value of the corresponding working coil when the object is loaded on the working coil. Alternatively, the reference value may be preset.

When the second comparison result (e.g., the difference between the total power consumption of the first and second working coils WC1 and WC2 and the power consumption of the first working coil WC1) is equal to or greater than the reference value (the minimum or average power consumption value of the first corresponding working coil when the object is loaded on the first working coil), the concurrent operations of the first and second working coils WC1 and WC2 may be initiated (S350).

That is, when the second comparison result is greater than or equal to the reference value, the main control unit 300 may determine to operate the first and second working coils WC1 and WC2 concurrently. In this case, the single object may be heated by both the first and second working coils WC1 and WC2.

Conversely, when the second comparison result is smaller than the reference value, the control unit may not operate the first and second working coils WC1 and WC2 concurrently. That is, the concurrent operation of the first and second working coils WC1 and WC2 may be suspended (S300).

That is, when the second comparison result is smaller than the reference value, the main control unit 300 may determine not to operate the first and second working coils WC1 and WC2 concurrently. In this case, when, subsequently, the user's input (that is, a command for the concurrent operation) is provided via the input interface, the control unit may perform the above-described detection again based on the corresponding user input.

The above-described method and process may realize the object-detection when the induction heating device 1 is driven in the flex mode.

In the induction heating device 1 according to one embodiment of the present disclosure, the object-detection algorithm when the device is running in the flex mode may be improved. Thus, the user may easily check whether an object on an area corresponding to an area between the working coils is correctly positioned for enablement of the flex mode. Thus, a burden that the user should place the object on a correct position for driving of the induction heating device in the flex mode may be eliminated. Thus, user convenience may be improved.

Further, in the induction heating device 1 according to one embodiment of the present disclosure, an improved circuit structure may improve heating-region control and output control. This reduces the object heating time and improves the accuracy of the heating intensity adjustment. Further, the object heating time reduction, and improved heating intensity adjustment accuracy may result in shorter cooking timing by the user, thereby resulting in improved user satisfaction.

In the above description, numerous specific details are set forth in order to provide a thorough understanding of the present disclosure. The present disclosure may be practiced without some or all of these specific details. Examples of various embodiments have been illustrated and described above. It will be understood that the description herein is not intended to limit the claims to the specific embodiments described. On the contrary, it is intended to cover alternatives, modifications, and equivalents as may be included within the spirit and scope of the present disclosure as defined by the appended claims.

What is claimed is:

1. An induction heating device comprising:

a first board comprising a first working coil, a first resonant capacitor, a first inverter, a first current transformer, and a first control unit that is configured to control operation of the first inverter; and a second board comprising a second working coil, a second resonant capacitor, a second inverter, a second current transformer, a first relay, a second relay, and a second control unit that is configured to control operation of each of the second inverter, the first relay, and the second relay, wherein the first resonant capacitor is connected to a first end of the first working coil, wherein the first inverter is configured to perform a first switching operation to apply a first resonant current to the first working coil, wherein the first current transformer is connected to a second end of the first working coil and configured to adjust a magnitude of the first resonant current output from the first inverter, wherein the second inverter is configured to perform a second switching operation to apply a second resonant current to the second working coil, wherein the second current transformer is configured to adjust a magnitude of the second resonant current output from the second inverter, wherein the first and second working coils are arranged side by side, wherein the induction heating device is configured to heat a plurality of heating regions comprising:

a first region that is located between the first working coil and the second working coil, and second regions that correspond to edges of the first working coil and the second working coil, the second regions being outside of the first region, wherein the second control unit is configured to control the first and second relays in a first state to heat the second regions or in a second state to heat the first region, wherein the second control unit is configured to, in the first state, control the first relay to connect a first end of the second working coil to the second current transformer, and control the second relay to connect a second end of the second working coil to the second resonant capacitor such that (i) the first resonant current having the adjusted magnitude flows from the second end of the first working coil to the first end of the first working coil, and (ii) the second resonant current having the adjusted magnitude flows from the first end of the second working coil to the second end of the second working coil, wherein the first resonant current flowing through the first working coil and the second resonant current flowing through the second working coil are in-phase in the first state, wherein the second control unit is configured to, in the second state, control the first relay to connect the first end of the second working coil to the first end of the first working coil, and control the second relay to connect the second end of the second working coil to the second end of the first working coil such that the first resonant current having the adjusted magnitude flows (i) from the second end of the first working coil to the first end of the first working coil and (ii) from the second end of the second working coil to the first end of the second working coil, and wherein the first resonant current flowing in the first working coil and the first resonant current flowing in the second working coil are out-of-phase by 180 degrees in the second state.

2. The induction heating device of claim 1, further comprising a main control unit that is configured to:

receive an input from a user through an input interface; and provide the input to at least one of the first control unit or the second control unit.

3. The induction heating device of claim 2, wherein the first control unit is configured to control operation of the first inverter based on the input received from the main control unit, and wherein the second control unit is configured to control operation of each of the second inverter, the first relay, and the second relay based on the input received from the main control unit.

4. The induction heating device of claim 3, wherein the main control unit is further configured to, in response to reception of an input indicating a concurrent operation of the first working coil and the second working coil:

perform a first object detection to determine, based on a measure related to a set of the first working coil and the second working coil, whether one or more objects are located at an area of the induction heating device corresponding to at least one of the first working coil or the second working coil;

control each of the first control unit and the second control unit to perform a second object detection to determine, based on a measure related to each of the first working coil and the second working coil, whether an object is located at an area of the induction heating device corresponding to each of the first working coil and the second working coil; and determine performance of the concurrent operation of the first working coil and the second working coil (i) based on a result from the first object detection and (ii) based on results from the second object detection.

5. The induction heating device of claim 3, wherein the first control unit is further configured to, in response to reception of an input indicating an individual operation of the first working coil or the second working coil:

perform an object detection to determine whether a first object is located at a first area of the induction heating device corresponding to the first working coil; and determine performance of the individual operation of the first working coil based on a result from the object detection indicating that the first object is located at the first area of the induction heating device corresponding to the first working coil, and wherein the second control unit is further configured to, in response to reception of the input indicating the individual operation of the first working coil or the second working coil:

perform the object detection to determine whether a second object is located at a second area of the induction heating device corresponding to the second working coil, and determine performance of the individual operation of the second working coil based on a result from the object detection indicating that the second object is located at the second area of the induction heating device corresponding to the second working coil.

6. The induction heating device of claim 2, wherein the first control unit and the second control unit are further configured to, based on the input received from the main control unit, determine whether to heat the first region.

7. The induction heating device of claim 6, wherein the first control unit is further configured to, in response to reception of an input indicating that the first region of the induction heating device does not correspond to a target heating region, drive the first inverter, and wherein the second control unit is further configured to, in response to reception of the input indicating that the first region of the induction heating device does not correspond to the target heating region:

drive the second inverter;

control the first relay to connect the first end of the second working coil to the second current transformer; and control the second relay to connect the second end of the second working coil to the second resonant capacitor.

8. The induction heating device of claim 6, wherein the first control unit is further configured to, in response to reception of an input indicating that the first region of the induction heating device corresponds to a target heating region, drive the first inverter, and wherein the second control unit is further configured to, in response to reception of the input indicating that the first region of the induction heating device corresponds to the target heating region:

control the first relay to connect the first end of the second working coil to the first end of the first working coil; and control the second relay to connect the second end of the second working coil to the second end of the first working coil.

9. The induction heating device of claim 6, wherein the main control unit is further configured to:

set the first region of the induction heating device as a non-target region; and based on control signals having a same frequency, drive the first working coil and the second working coil in the first state to heat the second regions.

10. The induction heating device of claim 9, wherein the first control unit is configured to control the first working coil based on a first control signal having a first frequency and a first phase, and wherein the second control unit is configured to, in the first state, control the second working coil based on a second control signal having the first frequency and the first phase.

11. The induction heating device of claim 1, further comprising:

a first power supply configured to provide power to the first working coil; and a second power supply configured to provide power to the second working coil, the second power supply being independent of the first power supply.

12. The induction heating device of claim 11, further comprising:

a first rectifier connected to the first power supply and configured to convert power supplied from the first power supply to a first direct current; and a second rectifier connected to the second power supply and configured to convert power supplied from the second power supply to a second direct current, wherein the first inverter is configured to generate the first resonant current from the first direct current, and wherein the second inverter is configured to generate the second resonant current from the second direct current.

13. The induction heating device of claim 1, wherein the first inverter comprises a plurality of switching elements that are configured to generate an alternating current corresponding to the first resonant current, and wherein the first current transformer is connected to a node between the plurality of switching elements of the first inverter.

14. The induction heating device of claim 13, wherein the first resonant capacitor is connected to an end of the plurality of switching elements of the first inverter.

15. The induction heating device of claim 1, wherein the second inverter comprises a plurality of switching elements that are configured to generate an alternating current corresponding to the second resonant current, and wherein the second current transformer is connected to a node between the plurality of switching elements of the second inverter.

16. The induction heating device of claim 15, wherein the second resonant capacitor is connected to an end of the plurality of switching elements of the second inverter.

17. The induction heating device of claim 4, wherein the measure related to the set of the first working coil and the second working coil comprises at least one of (i) an amount of total power consumption by the first working coil and the second working coil or (ii) a sum of the first resonant current and the second resonant current, and wherein the measure related to each of the first working coil and the second working coil comprises at least one of (i) an amount of power consumption by each of the first working coil and the second working coil or (ii) each of the first resonant current and the second resonant current.

18. The induction heating device of claim 6, wherein the main control unit is further configured to:

set the first region of the induction heating device to a target heating region; and based on control signals having a same frequency, drive the first working coil and the second working coil in the second state to heat the target heating region.

19. The induction heating device of claim 18, wherein the first control unit is configured to control the first working coil based on a first control signal having a first frequency and a first phase, and wherein the second control unit is configured to, in the second state, control the second working coil based on a second control signal having the first frequency and a second phase that is out of phase from the first phase by 180 degrees.

20. The induction heating device of claim 1, wherein the first relay is located between the second current transformer and the first end of the second working coil, and wherein the second relay is located between the second end of the second working coil and the second resonant capacitor.

* * * * *